United States Patent [19]

Beer et al.

[11] Patent Number: 4,798,181

[45] Date of Patent: Jan. 17, 1989

[54] VALVE GUIDANCE FOR AN EXHAUST GAS VALVE OF AN INTERNAL COMBUSTION ENGINE

[75] Inventors: Michael Beer, Wimsheim; August Hofbauer, Pforzheim; Erwin Knoll, Weissenhorn, all of Fed. Rep. of Germany

[73] Assignee: Dr. Ing. h.c.f. Porsche Aktiengesellschaft, Stuttgart, Fed. Rep. of Germany

[21] Appl. No.: 30,564

[22] Filed: Mar. 27, 1987

[30] Foreign Application Priority Data

Mar. 27, 1986 [DE] Fed. Rep. of Germany ..... 3610534

[51] Int. Cl.[4] ..... F01L 3/08

[52] U.S. Cl. ..... 123/188 GC; 29/156.7 R

[58] Field of Search ..... 123/188 GC; 29/156.7 R

[56] References Cited

U.S. PATENT DOCUMENTS

| | | | |
|---|---|---|---|
| 2,032,162 | 2/1936 | Zahodiakin | 29/156.7 R |
| 3,728,994 | 4/1973 | Bachle | 123/188 GC |
| 4,465,040 | 8/1984 | Pelizzoni | 123/188 GC |

FOREIGN PATENT DOCUMENTS

| | | | |
|---|---|---|---|
| 1148812 | 5/1963 | Fed. Rep. of Germany . | |
| 1236860 | 3/1967 | Fed. Rep. of Germany . | |
| 2216512 | 10/1973 | Fed. Rep. of Germany . | |
| 3318899 | 11/1984 | Fed. Rep. of Germany . | |
| 495410 | 1/1956 | Italy | 123/188 GC |
| 571554 | 8/1945 | United Kingdom . | |
| 869384 | 5/1961 | United Kingdom | 123/188 GC |
| 1151300 | 5/1969 | United Kingdom . | |

*Primary Examiner*—Andrew M. Dolinar

*Attorney, Agent, or Firm*—Barnes & Thornburg

[57] ABSTRACT

A valve guidance for an exhaust gas valve in the form of a disk valve of an internal combustion engine which is used for the control of an exhaust gas channel of an internal combustion engine; a guide body with good heat-conducting and sliding properties serves as valve guidance. The guide body is coated at the inlet place of the valve stem either with a hard metal coating applied by plasma-spray process or with a hard metal sleeve.

14 Claims, 1 Drawing Sheet

VALVE GUIDANCE FOR AN EXHAUST GAS VALVE OF AN INTERNAL COMBUSTION ENGINE

The present invention relates to a valve guidance for a disk valve of an internal combustion engine used for the control of an exhaust gas channel which includes a guide body with good heat-conducting and sliding properties for the valve stem longitudinally guided within the same.

Very high demands are made of such a valve guidance for a disk valve which serves for the control of the hot exhaust gases of an internal combustion engine. In order to keep small the friction coefficient and therewith the mechanical power loss, a material with good sliding qualities, for example, a bronze or brass alloy must be used. A wear then occurs to a lesser extent at the disk valve made of steel rather than at the more soft valve guidance, especially at the inlet place of the valve stem in the valve guidance. For at this place the oil carbon which becomes stuck at the disk valve penetrates into the valve guidance and causes a very strong wear.

Ceramic bushings are proposed in the DE-OS No. 33 18 899 which are quite wear resistant but do not possess very good slide properties. Additionally, the heat-conducting ability of ceramic material is not particularly good so that the heat cannot be conducted sufficiently rapidly from the valve stem of the disk valve to the cylinder head, respectively, to another housing in which the valve guidance is seated.

The object of the present invention resides in providing a wear-resistant valve guidance with good heat conducting and sliding properties.

The underlying problems are solved according to the present invention in that the guide body includes in the area projecting into the exhaust gas channel a hard metal coating. If the valve stem is longitudinally guided in a guide body which, on the one hand, has good sliding properties and is a good heat conductor and, on the other hand, has a hard metal coating at the inlet place of the valve stem, the requirements for a good heat transfer and wear-resistant construction of the valve guidance are optimally fulfilled. The hard metal coating can be applied either on the guide body directly by plasma-spray process, or can be pressed into the guide body as hard metal bushing. Alternatively thereto, a guide bushing may be used as guide body which is inserted into the cylinder head of the internal combustion engine and whose end projecting into the exhaust gas channel carries the hard metal coating. Also in this case, the hard metal coating can be constructed as layer applied by plasma-spray process or can be pressed over the end face of the guide bushing as pot-shaped sleeve. In all cases, the wear resistant hard metal coating scrapes off from the valve stem the oil carbon adhering thereto and thus prevents the penetration thereof into the gap between valve stem and guide body. At the same time, the hard metal coating serves as corrosion protection against the chemically aggressive exhaust gases. Hard metal in the sense of the present invention is an alloy of iron-like components which also includes high alloyed high-grade steels.

These and other objects, features and advantages of the present invention will become more apparent from the following description when taken in connection with the accompanying drawing which shows, for purposes of illustration only, several embodiments in accordance with the present invention, and wherein.

Figure 1:
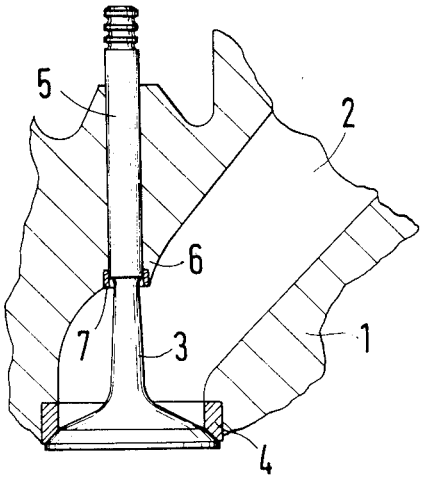
FIG. 1 is a partial cross-sectional view through a cylinder head with a valve guidance in accordance with the present invention.

Referring now to the drawing wherein like reference numerals are used throughout the various views to designate like parts, a cylinder head 1 of an internal combustion engine includes an exhaust gas channel 2 which is controllable by a disk valve 3 which in the closing position abuts at a seating ring 4. According to FIG. 1, the valve stem 5 of the disk valve 3 is longitudinally guided in a guide bore of the cylinder head 1 cast of light metal, whereby the cylinder head 1 serves directly as guide body and conducts the heat away from the valve stem 5. A hard metal bushing 7 is pressed into an eye 6 protruding into the exhaust gas channel 2, the inner diameter of the bushing 7 is approximately equal to the diameter of the guide bore. When the disk valve 3 is displaced from its lower open position upwardly into the closing position, the hard metal bushing 7 abutting at the valve stem 5 acts, so to speak of, as scraper and keeps the oil carbon adhering at the valve stem 5 away from the guide bore.

Figure 2:
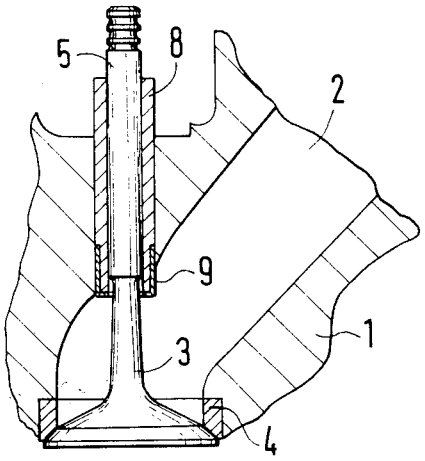
FIG. 2 is a partial cross-sectional view through a cylinder head with a valve guidance having a hard metal coating in accordance with the present invention.

According to FIG. 2, a guide sleeve 8 of a copper alloy, for example, of brass, is pressed into a bore of the cylinder head 1, which produces a good slide guidance for the disk valve 3 made of steel and at the same time has a good heat-conducting coefficient. Over the end protruding into the exhaust gas channel 2, a hard metal coating 9 is applied onto the guide bushing 8 by plasma-spray process, which covers the end face of the guide bushing 8 and the outer cylindrical area adjoining the same.

After the spraying-on process, the hard metal coating 9 is ground to finished dimension.

The end face coating acts like the hard metal bushing 7 of FIG. 1 as scraper for the oil carbon and assures that the same cannot penetrate into the guide sleeve 8. The coating of the guide sleeve 8 along the outside thereof protects the same against corrosive attack of the hot exhaust gases.

Figure 3:
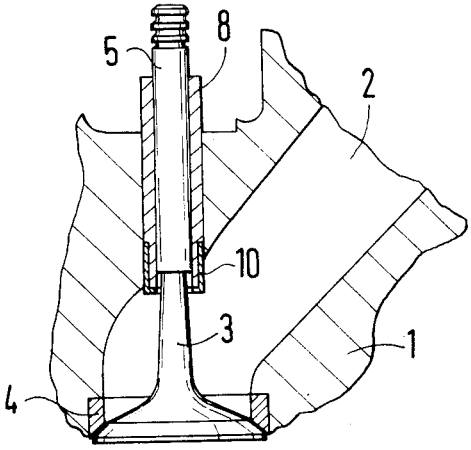
FIG. 3 is a partial cross-sectional view through a valve guidance with a hard metal sleeve in accordance with the present invention.

In the alternative, according to FIG. 3, a pot-shaped hard metal sleeve 10 is pressed over the guide sleeve 8 at the end protruding into the exhaust gas channel 2. The wall thickness of the hard metal sleeve 10 amounts to about 1.5 mm. and is slightly greater than the layer thickness of a high grade steel coating 9 applied by plasma process, whose layer thickness amounts to about 0.2 to 0.8 mm.

In a preferred embodiment, an alloy of 40% cobalt, 22.5% nickel, 25.5% chromium and 12.2% of tungsten by weight is chosen for the hard metal coating 9, respectively, the hard metal bushing 7 which is commercially available under the designation "Stellit."

Such a hard metal or high-grade steel coating can also be utilized for the valve guidance of an exhaust gas valve which is used in a turbocharger installation, for example, as by-pass valve. It also renders in that case the valve guidance so wear-resistant that no noticeable wear is indicated even after an operating period of several thousand hours. As the hard metal coating abuts at the valve stem 5 only over a very short distance, the heat conduction from the valve stem 5 is not significantly impaired.

While we have shown and described several embodiments in accordance with the present invention, it is understood that the present invention is not limited thereto but is susceptible of numerous changes and modifications as known to those skilled in the art. For example, the alloy composition can be varied as known to those skilled in the art. Thus, the present invention is not limited to the particular preferred alloy indicated hereinabove, but any other equivalent alloy may be used. Consequently, we do not wish to be limited to the details shown and described herein but intend to cover all such changes and modifications as are encompassed by the scope of the appended claims.

We claim:

1. A valve guidance for a disk valve of an internal combustion engine used for the control of an exhaust gas channel, comprising a guide body means having good heat-conducting and slide properties for the valve stem of the disk valve longitudinally guided in said guide body means, the guide body means having a hard metal coating means which defines an uninterrupted cylindrical surface therewith in the area thereof protruding into the exhaust gas channel for scraping oil carbon from said valve stem.

2. A valve guidance according to claim 1, wherein a cylinder head of the internal combustion engine cast of light metal serves as guide body means, said guide body means having a guide bore, and wherein a hard metal bushing inserted into the guide bore in the direction from the exhaust gas channel, and the valve stem being fitted into the hard metal bushing.

3. A valve guidance according to claim 1, wherein a guide sleeve means serves as guide body means which is inserted into a bore of the cylinder head extending up to the exhaust gas channel, the guide sleeve means being coated at the end protruding into the exhaust gas channel with a cap-shaped hard metal layer.

4. A valve guidance according to claim 1, wherein a hard metal coating is applied by plasma-spray process.

5. A valve guidance according to claim 3, wherein a pot-shaped hard metal sleeve is pressed over the guide sleeve means in the direction from the exhaust gas channel, the valve stem being guided in a central end face bore of the hard metal sleeve means.

6. A valve guidance according to claim 1, wherein the layer thickness, respectively, wall thickness, of the hard metal coating amounts to between about 0.2 to about 1.5 mm.

7. A valve guidance according to claim 1, wherein the guide body means consists of a copper alloy or aluminum alloy and the hard metal coating of an alloy of cobalt, nickel, chromium and tungsten.

8. A valve guidance according to claim 7, wherein the hard metal coating consists of an alloy having about 40% of cobalt, 22.5% of nickel, 25.3% of chromium and 12.2% of tungsten.

9. A valve guidance according to claim 8, wherein a hard metal coating is applied by plasma-spray process.

10. A valve guidance according to claim 1, wherein a pot-shaped hard metal sleeve is pressed over the guide sleeve means in the direction from the exhaust gas channel, the valve stem being guided in a central end face bore of the hard metal sleeve means.

11. A valve guidance according to claim 10, wherein the layer thickness, respectively, wall thickness, of the hard metal coating amounts to between about 0.2 to about 1.5 mm.

12. A valve guidance according to claim 10, wherein the guide body means consists of a copper alloy or aluminum alloy and the hard metal coating of an alloy of cobalt, nickel, chromium and tungsten.

13. A valve guidance according to claim 12, wherein the hard metal coating consists of an alloy having about 40% of cobalt, 22.5% of nickel, 25.3% of chromium and 12.2% of tungsten.

14. A valve guidance according to claim 12, wherein the layer thickness, respectively, wall thickness, of the hard metal coating amounts to between about 0.2 to about 1.5 mm.

* * * * *